US006443691B1

(12) United States Patent
Nather

(10) Patent No.: US 6,443,691 B1
(45) Date of Patent: Sep. 3, 2002

(54) FEED PUMP

(75) Inventor: Helmut Nather, Bad Camberg (DE)

(73) Assignee: Mannesmann VDO AG, Frankfurt am Main (DE)

( * ) Notice: Subject to any disclaimer, the term of this patent is extended or adjusted under 35 U.S.C. 154(b) by 45 days.

(21) Appl. No.: 09/650,235

(22) Filed: Aug. 29, 2000

(30) Foreign Application Priority Data

Sep. 2, 1999 (DE) ..... 199 41 786

(51) Int. Cl.[7] ..... F04B 15/00
(52) U.S. Cl. ..... 415/55.1; 416/223 R
(58) Field of Search ..... 415/55.1, 55.2, 415/55.3, 55.4; 416/223 R, 243, 179, 182, 183, 185

(56) References Cited

U.S. PATENT DOCUMENTS

| | | | | |
|---|---|---|---|---|
| 3,947,149 A | | 3/1976 | MacManus | 415/213 |
| 3,951,567 A | * | 4/1976 | Rohs | 415/119 |
| 5,536,139 A | * | 7/1996 | Yamazaki et al. | 415/55.1 |
| 5,558,490 A | | 9/1996 | Dobler | 415/55.1 |
| 5,577,881 A | * | 11/1996 | Hablanian | 415/55.6 |
| 6,132,185 A | * | 10/2000 | Wilhelm | 417/423.15 |
| 6,152,687 A | * | 11/2000 | Wilhelm et al. | 415/55.1 |

FOREIGN PATENT DOCUMENTS

| | | | |
|---|---|---|---|
| DE | 1 403 277 | 10/1968 | |
| DE | 40 20 521 | 1/1992 | F04D/5/00 |
| DE | 196 15 322 | 10/1997 | F04D/5/00 |
| FR | 2 008 311 | 1/1970 | F04D/17/00 |
| FR | 2 768 192 | 9/1997 | F04D/5/00 |

* cited by examiner

*Primary Examiner*—F. Daniel Lopez
*Assistant Examiner*—James M McAleenan
(74) *Attorney, Agent, or Firm*—Cohen, Pontani, Lieberman & Pavane

(57) ABSTRACT

In an impeller of a feed pump designed as a side channel pump, each of the vane chambers are divided into two sectors which are arranged in an undercut-free design relative to a direction perpendicular to the end face of the impeller. When the impeller is manufactured from plastic by injection molding, the sectors may be produced by projections arranged on mold halves intended for the manufacture of the impeller. After the production of the impeller, the projections in the mold halves having the geometric shape of the sectors may be drawn axially apart from one another in one simple step, thereby providing a cost-effective production of the impeller.

9 Claims, 2 Drawing Sheets

FEED PUMP

BACKGROUND OF THE INVENTION

1. Field of the Invention

The present invention relates to a peripheral or side channel feed pump with a driven impeller which rotates in a casing and in which guide vanes delimiting a ring of vane chambers is arranged, wherein the casing includes part-annular channels arranged therein proximate the guide vanes to form with the vane chambers a feed chamber for feeding a liquid from an inlet duct to an outlet duct, the vane chambers passing through the impeller and including at least two sectors or areas connected to one another, each sector being contiguous to at least one end face of the guide vanes.

2. Description of the Related Art

Peripheral or side channel feed pumps are used, for example, in present-day motor vehicles for feeding fuel or washing liquid. These feed pumps often have the flow passing through them axially and therefore have a particularly compact design. The impeller of the known feed pump has a nonround recess which passes straight through the impeller and is slipped onto an electric motor shaft designed in conformity to the recess. The geometry of the vane chambers may be configured to adapt the feed pump to an intended characteristic curve and to the viscosity of the liquid to be fed. This adaption is critical for the efficiency of the feed pump in the intended application. V-shaped guide vanes are often used in axial-throughflow feed pumps. Sectors of the vane chambers extend from the end face of the impeller as far as the region where the guide vanes are angled. The impeller is manufactured or sintered mostly from plastic by the injection molding method.

A disadvantage of the known feed pump is that the impeller is difficult to manufacture. Halves of a mold such as, for example, an injection mold, a transfer mold, or a sintering mold are in each, case provided with projections designed in conformity to the sectors of the guide chambers to be produced between the guide vanes. To remove the impeller from the mold, the halves have to be rotated simultaneously and drawn apart from one another because of the V-shaped configuration of the guide vanes. Furthermore, a core with a central recess requires a separate manufacturing step because the central recess is oriented perpendicularly to the end faces of the impeller. The above factors lead to a highly cost-intensive manufacture of the impeller.

A proposed solution comprises leading the vane chambers straight through the impeller. As a result, the impeller can easily be manufactured in an axial-removal mold. However, the feed pump provided with such an impeller has particularly low efficiency.

SUMMARY OF THE INVENTION

An object of the present invention is to provide a peripheral or side-channel feed pump that may be configured in a large number of applications and that has an impeller that can be manufactured as simply as possible.

The object is met, according to an embodiment of the present invention, by an impeller comprising two opposing axial end faces and a plurality of guide vanes arranged in circumferential succession. Each adjacent pair of guide vanes defines a vane chamber therebetween which comprises two sectors. At least one of the sectors facing one of the end faces of the impeller is designed in an undercut-free arrangement relative to a direction perpendicular to this end face.

The undercut-free design of the sectors allows the impeller to be removed from an injection mold in one simple step when the projections of two mold halves are designed in the shape of the sectors. Mold parts for forming the undercut-free sectors may therefore be manufactured in one piece for forming both the guide vanes and a core having a central recess. Consequently, a separate manufacturing step for forming the core is not required for producing the impeller by injection molding, transfer, or sintering. The impeller can thus be manufactured in a particularly simple and cost-effective way. By a suitable design of the sectors, the feed pump may be configured for use in a wide variety of applications as a result of a suitable choice in the geometry of the vane chambers.

According to an advantageous development of the invention, the formation of burrs between the two sectors may be largely avoided if the vane chambers lead straight through the impeller over their entire height in at least one narrow region. This design allows the mold parts of the impeller to be brought reliably into a position during the production of the impeller in which they rest against one another without a gap. Furthermore, a burr which does form between the mold parts in the vane chambers is thereby located in a central portion of the vane chamber between two vane guides and points in radial directions of the impeller. Consequently any burrs which may possibly form are arranged in a region located outside the guide vanes. A possible burr therefore leads merely to insignificant flow losses within the vane chambers.

The feed pump according to the present invention has particularly high efficiency when one of the sectors comprises an inlet region of the impeller and is in the form of a nozzle and the opposite sector comprises an outlet region of the impeller and is in the form of a diffuser. Alternatively, the sectors may in each case have parts both of the diffuser and of the nozzle in their regions contiguous to one another.

A further increase in the efficiency of the feed pump according to the present invention may be achieved when a tangential section of each guide vane has an L-shaped design.

According to another advantageous embodiment of the present invention, the flow fed into the outlet-side part-annular channel experiences particularly high acceleration in the vane chambers when the outlet-side leg of the guide vanes is arranged approximately perpendicularly to the end face of the impeller. The feed pump according to the invention may thereby generate a particularly high pressure.

According to another advantageous embodiment of the present invention, turbulences of the flow to be fed are kept particularly low when the free end of the inlet-side leg of the L-shaped guide vane is rounded. As a result the feed pump according to the invention may be suitable particularly for use as a fuel pump, since hot fuel tends to evaporate in the active turbulences. Such evaporation leads to a sharp drop in the efficiency of the feed pump.

A uniform and turbulence-free acceleration of the flow within the vane chambers may be ensured in a simple way when the guide vane contour facing away from the direction of movement to the impeller has an essentially uniform radius of curvature. As a result, the contour pointing in the direction of movement can be adapted for the intended characteristic curve and for the respective application of the feed pump.

Turbulences during the transition of the flow from the vane chambers into the outlet-side part-annular channel may be avoided in a simple way when the contour of the outlet-side region of the guide vanes is oriented so as to point opposite to the direction of movement of the impeller.

According to a further embodiment of the present invention, a particularly high pressure of the fed medium may be achieved when the outlet duct is configured as a diffuser.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
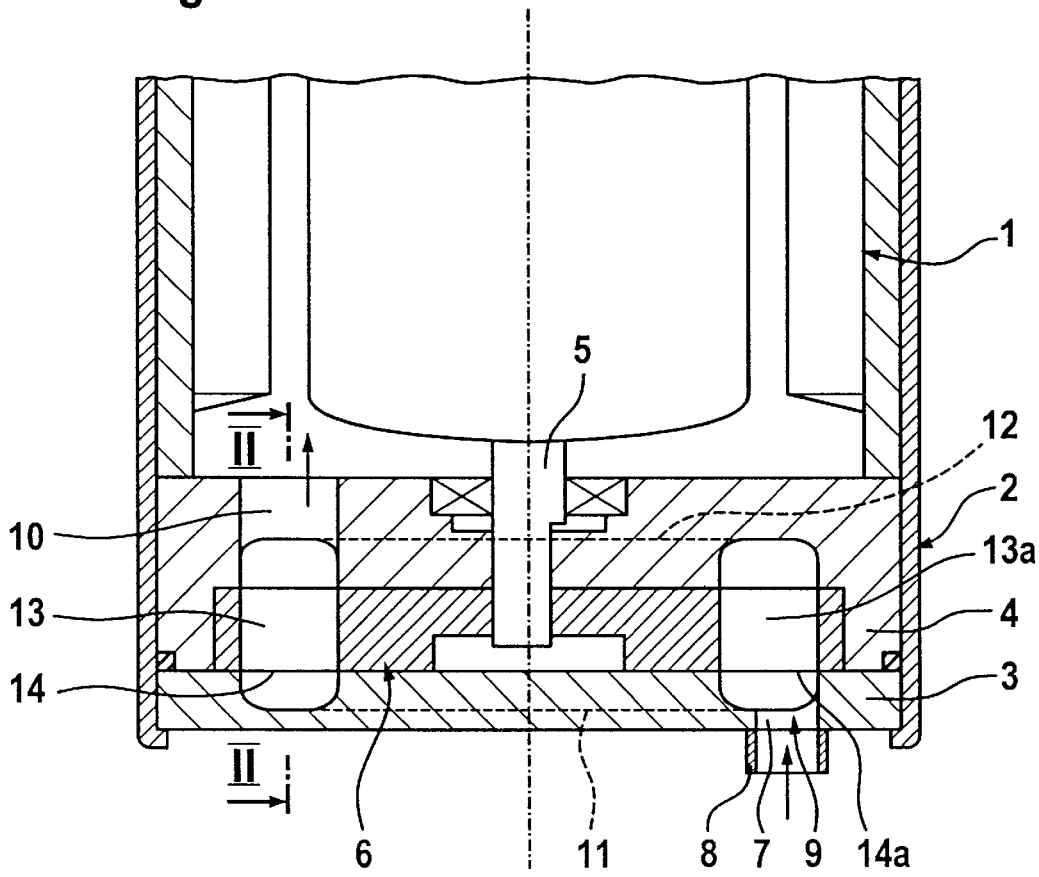
FIG. 1 is a partial longitudinal sectional view of a feed pump according to an embodiment of the present invention.

Referring to FIG. 1, a feed pump 2 according to an embodiment of the present invention is driven by an electric motor 1 and designed as an axial-throughflow side channel pump. The feed pump 2 comprises an inlet-side casing part 3 and an outlet-side casing part 4. The inlet- and outlet-side casing parts 3, 4 are supported on one another in a narrow radially outer region. An impeller 6 is rotatably arranged between the inlet- and outlet-side casing parts 3, 4 and is fastened on a shaft 5 of the electric motor 1. The inlet-side casing part 3 has an inlet duct 7 which extends from a connection piece 8 to a feed chamber 9 defined between the inlet-side casing part 3 and the outlet-side casing part 4. The feed chamber 9 leads through the impeller 6 to an outlet duct 10 which opens toward the electric motor 1. The feed chamber 9 is formed by part-annular channels 11, 12 arranged in the inlet- and outlet-side casing parts 3, 4 and by vane chambers 13, 13*a* arranged through the impeller 6. The vane chambers 13, 13*a* are delimited by guide vanes 14, 14*a* of the impeller wheel 6.

Figure 2:
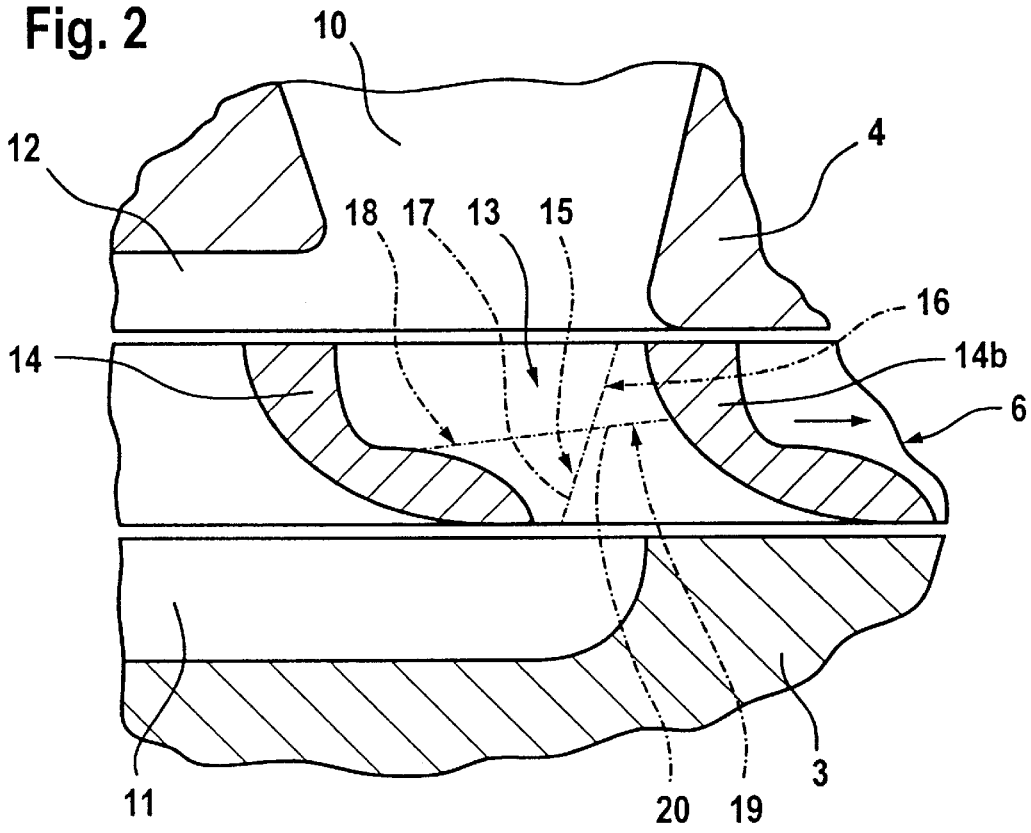
FIG. 2 is a partial tangential sectional view of the feed pump in FIG. 1 along the line II—II.

FIG. 2 shows two of the guide vanes 14, 14*b* and the ends of the part-annular channels 11, 12 in a tangential partial section through the feed pump 2 in the region of the outlet duct 10. The vane chambers 13 are divided into two sectors 15, 16 which in each case have an undercut-free design relative to a direction perpendicular to an end face of the impeller 6. An undercut is a projection of the sector that obstructs removal of the sector 15 or 16 from the vane chamber 13 in a path perpendicular to the end face of the impeller 6. During production of the impeller 6, the projections connected to mold halves of a die to form the vane chambers 13, 13*a* are formed in the shape of the sectors 15, 16. As a result of the undercut-free design of the sectors 15, 16, the mold halves may be drawn axially apart from one another in one simple step after the production of the impeller 6 in a mold. FIG. 2 shows a parting line 17 of the sectors 15, 16 which runs between the guide vanes 14, 14*b*. Any burrs which may form during the production of the impeller 6 between the projections of the mold halves are formed at a location away from the guide vanes 14, 14*b*. Accordingly, even if burrs are formed they have a minimal impact on the flow of liquid through the vane chambers 13, 13*a*.

In the embodiment of FIG. 2, the guide vanes 14, 14*b* have an L-shaped design. The direction of movement of the impeller 6 is depicted by arrow A. The side of the guide vanes 14, 14*b* which faces away from the direction of movement A has a uniform radius of curvature. The side of the guide vanes 14, 14*b* which faces the direction of movement is arranged so that it is virtually perpendicularly to the end face of the impeller 6 in the area proximate the outlet duct 10. As a result of this design, the inlet-side part regions of the vane chambers 13 are in each case designed as a nozzle 18 and the outlet-side part regions in each case as a diffuser 19. For the sake of clarity, a parting line 20 between the nozzle 18 and the diffuser 19 is illustrated by dashes and dots in the drawing. The outlet duct 10 is likewise in the form of a diffuser.

Figure 3:
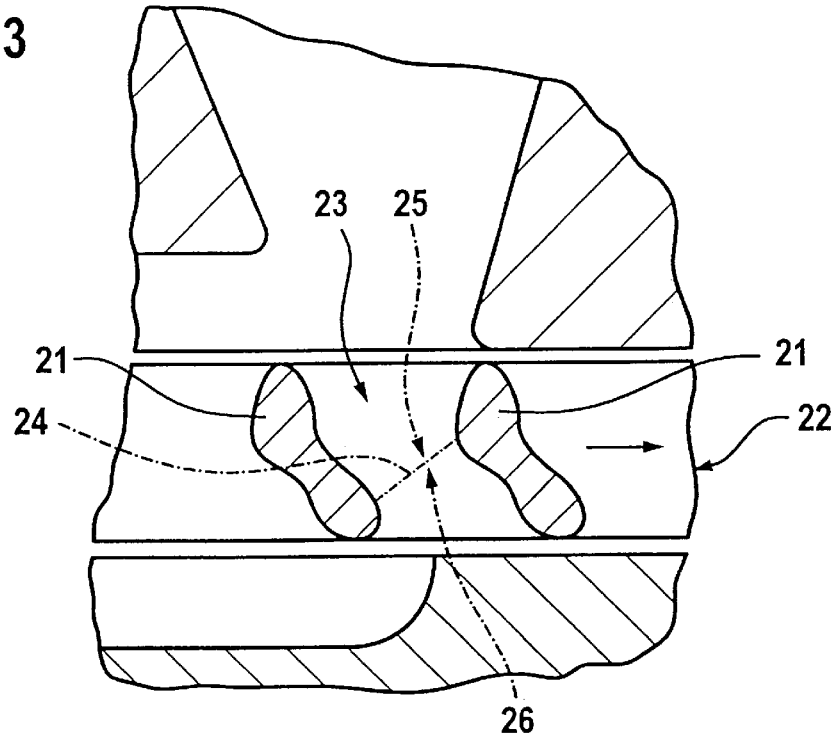
FIG. 3 is a partial tangential section view of a feed pump according to another embodiment of the present invention in the region of an outlet duct.

FIG. 3 shows a further embodiment of the feed pump comprising an impeller 22 with guide vanes 21, 21*a*. In this case, vane chambers 23 arranged between the guide vanes 21, 21*a* widen toward each of the end faces of the impeller 22. A parting line 24 between two sectors 25, 26 therefore runs in the region of the guide vanes 21, 21*a*. As a result, each of the sectors 25, 26 have an undercut-free design relative to a direction perpendicular to one of the end faces of the impeller 22.

The feed pumps illustrated in FIGS. 1 to 3 are side channel pumps. It should be noted that the feed pumps may, of course, also be designed as peripheral pumps in which the guide vanes 14, 21 are respectively arranged on the outer circumference of the impeller 6, 22.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

I claim:

1. A feed pump, comprising a casing comprising part-annular channels, an inlet duct, and an outlet duct and a driven impeller rotatably arranged in said casing and comprising a first end face, a second end face, and a ring of guide vanes delimiting vane chambers which pass through said driven impeller from said first end face to said second end face of said driven impeller, wherein said vane chambers and said part-annular channels define a feed chamber in said casing for feeding a liquid from said inlet duct to said outlet duct, each of said vane chambers comprising at least two sectors adjoining one another, wherein each of said two sectors is contiguous to one of said first and second end faces and said each of said two sectors comprises an undercut-free design relative to a direction perpendicular to said one of said first and second end faces so that a projection in the form of said each of said two sectors may be removed from said impeller in the direction perpendicular to said one of said first and second end faces without obstruction.

2. The feed pump of claim 1, wherein each of said vane chambers comprises at least one narrow region which passes straight through said impeller from said first end face to said second end face in a direction perpendicular to said first and second end faces.

3. The feed pump of claim 1, wherein one of said at least two sectors comprises an inlet region of said driven impeller arranged in the form of a nozzle and another of said at least two sectors comprises an outlet region of said driven impeller arranged in the form of a diffuser.

4. The feed pump of claim 1, wherein a contour of a side of said guide vanes which faces away from a direction of movement of said driven impeller comprises a uniform radius of curvature.

5. The feed pump of claim 1, wherein each of said guide vanes comprises an inlet-side region and an outlet-side region and a contour of said outlet-side region of said guide vanes is oriented away from the direction of movement of said driven impeller.

6. The feed pump of claim 1, wherein said outlet duct comprises a diffuser.

7. A feed pump, comprising a casing comprising part-annular channels, an inlet duct, and an outlet duct and a driven impeller rotatably arranged in said casing and comprising a ring of guide vanes delimiting vane chambers which pass from a first end face to a second end face of said driven impeller, wherein said vane chambers and said part-annular channels define a feed chamber in said casing for feeding a liquid from said inlet duct to said outlet duct, each of said vane chambers comprising at least two sectors adjoining one another, wherein each of said two sectors is contiguous to one of said first and second end faces and said each of said two sectors comprises an undercut-free design relative to a direction perpendicular to said one of said first and second end faces so that a projection in the form of said each of said two sectors may be removed from said impeller in the direction perpendicular to said one of said first and second end faces without obstruction, and wherein a tangential cross-section of each of said guide vanes comprises an L-shaped design.

8. The feed pump of claim 7, wherein each of said guide vanes comprises an inlet-side leg and an outlet-side leg, wherein said outlet-side leg comprises a vertical portion of said L-shaped design and is arranged so that said outlet-side leg is approximately perpendicular to said first and second end faces of said driven impeller.

9. The feed pump of claim 7, wherein each of said guide vanes comprises an inlet-side leg and an outlet side leg and a free end of said inlet-side leg of said guide vane is rounded.

* * * * *